US005273132A

United States Patent [19]

Sasaki et al.

[11] Patent Number: 5,273,132

[45] Date of Patent: Dec. 28, 1993

[54] COMPACT AERIAL LIFT VEHICLE WITH A VERTICALLY MOVABLE PLATFORM

[75] Inventors: Hiroshi Sasaki, Kounosu; Hideaki Tamura, Shiraoka; Yoshihiko Sakuma, Okegawa, all of Japan

[73] Assignee: Kabushiki Kaishi Aichi Corporation, Nagoya, Japan

[21] Appl. No.: 997,179

[22] Filed: Dec. 28, 1992

[30] Foreign Application Priority Data

Feb. 28, 1992 [JP] Japan ..... 4-018869[U]
Sep. 21, 1992 [JP] Japan ..... 4-071879[U]

[51] Int. Cl.[5] ..... B66B 9/20

[52] U.S. Cl. ..... 182/148; 182/113; 182/63; 187/9 R

[58] Field of Search ..... 182/148, 62.5, 2, 141, 182/113, 63; 187/9 R, 11

[56] References Cited

U.S. PATENT DOCUMENTS

| | | | |
|---|---|---|---|
| 597,205 | 1/1898 | Rue et al. | 182/148 X |
| 775,373 | 11/1904 | Maxey | 182/148 X |
| 4,258,825 | 3/1981 | Collins | 182/63 X |
| 4,421,209 | 12/1983 | Vermette et al. | 182/129 X |
| 4,875,555 | 10/1989 | Johansson et al. | 187/9 R |
| 5,052,521 | 10/1991 | Wendt et al. | 182/148 X |
| 5,203,425 | 4/1993 | Wehmeyer | 182/113 X |

*Primary Examiner*—Alvin C. Chin-Shue
*Attorney, Agent, or Firm*—Robert W. Usher

[57] ABSTRACT

An aerial lift vehicle, having a compact configuration and separable into several parts for storage, comprising a body having wheels, a detachable vertical post, and a platform attached to the upper portion of the vertical post, and vertically movable corresponding to the telescopic movement of the vertical post.

14 Claims, 8 Drawing Sheets

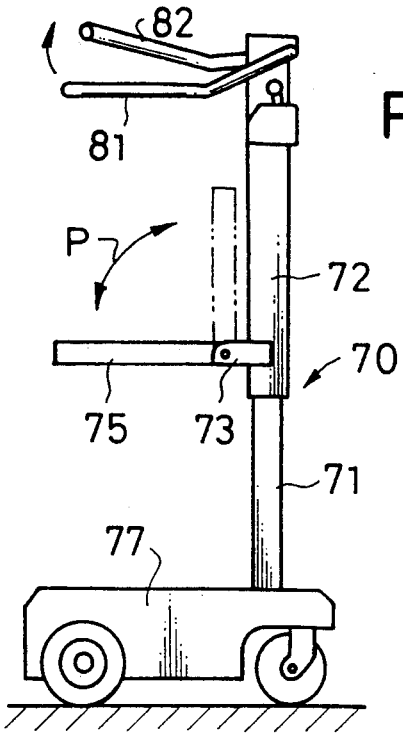
FIG.12
FIG.13
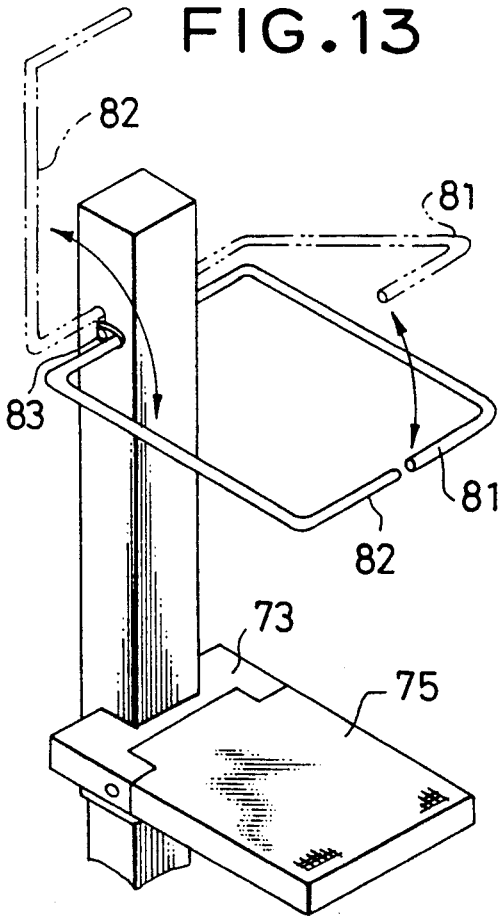
FIG.14
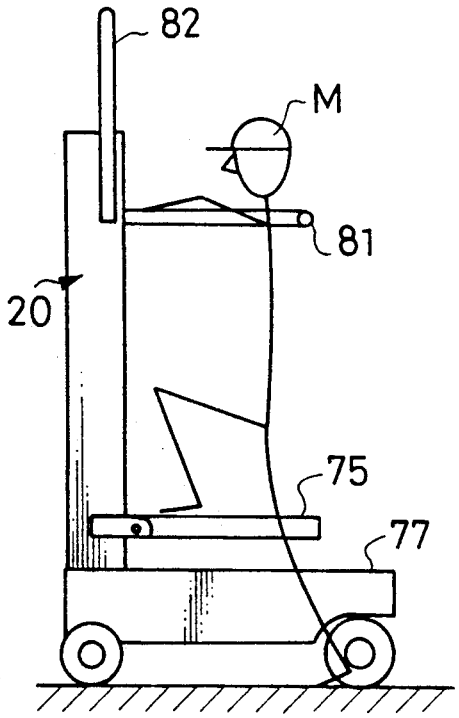

COMPACT AERIAL LIFT VEHICLE WITH A VERTICALLY MOVABLE PLATFORM

BACKGROUND OF THE INVENTION

1. Field of the Invention

The present invention relates to a compact aerial lift vehicle having a platform which supports an operator upright thereon and is vertically displaceable so as to lift the operator to a predetermined aerial position.

2. Description of the Related Arts

An aerial lift vehicle of vertically movable type is often used for interior finishing or wiring work within buildings. Such aerial lift vehicle comprises a running carriage freely capable of traveling, and a vertical post vertically telescopically mounted on the front or rear of the carriage. The vertical post includes a boarding platform for supporting an operator thereon and horizontally secured to the post. The boarding platform is vertically displaced along the vertical post in conjunction with the telescopic motion of the vertical post caused by the movement of a telescopic cylinder housed in a winch or the vertical post secured to the running carriage.

The use of such aerial lift vehicle conveniently facilitates a variety of aerial works (for example, a work for the attachment of a device to the ceiling indoors) through the travel of the running carriage and the vertical movement of the vertically movable platform at a working site.

The conventional aerial lift vehicle, although convenient for such works, was relatively large-sized and was not very suitable for the operation in a narrow site or indoors.

Owing to its bulky configuration, it disadvantageously presents its own heavy weight which makes it difficult to carry the aerial lift vehicle itself after and before the operation. In addition, it was sometimes difficult to secure a space enough to accommodate the aerial lift vehicle after the operation. In particular, the vertical post far extending vertically from the running carriage was often a great nuisance at the time of both conveyance and storage.

SUMMARY OF THE INVENTION

It is there an object of the present invention to provide an aerial lift vehicle having a compact configuration and suitable for the operation within a narrow site or indoors.

It is another object of the present invention to provide a compact aerial lift vehicle separable into several parts for the convenience of the conveyance and storage when not used.

In order to accomplish the above objects, the compact aerial lift vehicle in accordance with the present invention comprises a body having wheels so as to be capable of traveling; a vertical post detachably mounted on the body and vertically extending upward therefrom in a telescopical manner;

a platform attached to the upper portion of the vertical post and vertically movable corresponding to the telescopic movement of the vertical post; a travel drive means which drives the wheels for the travel of the vehicle; a telescopic drive means which imparts a telescopical movement to the vertical post; and a manual operating device attached to the upper portion of the vertical post and for drivingly controlling the travel drive means and the telescopic drive means, the device operated by an operator boarding the platform.

Due to its vertical post detachably mounted on the body and vertically extending upward therefrom, thus configured aerial lift vehicle can be easily disassembled for the convenience of the conveyance and storage by dismounting the vertical post from the body.

BRIEF DESCRIPTION OF THE DRAWINGS

FIG. 12 is a side elevational view showing the second embodiment of the present invention;

FIGS. 13 and 14 are a perspective view and a side elevational view, respectively, each showing the third embodiment of the present invention.

DESCRIPTION OF THE PREFERRED EMBODIMENTS

Figure 1A:
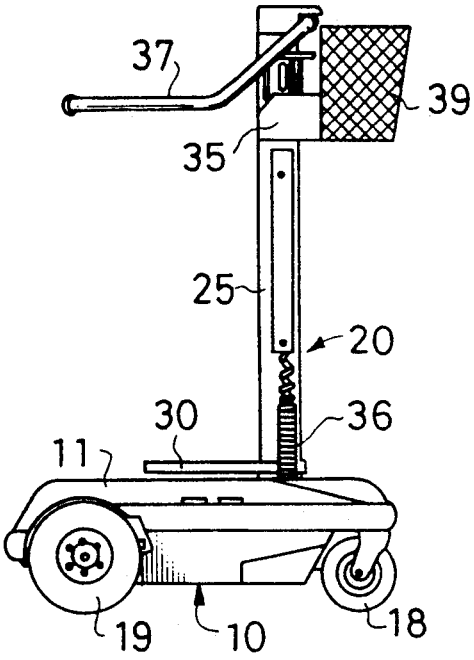
FIGS. 1A and 1B are side elevational views of the compact aerial vehicle constructed in accordance with the present invention, showing its vertical post being shortened and extended, respectively.
Figure 1B:
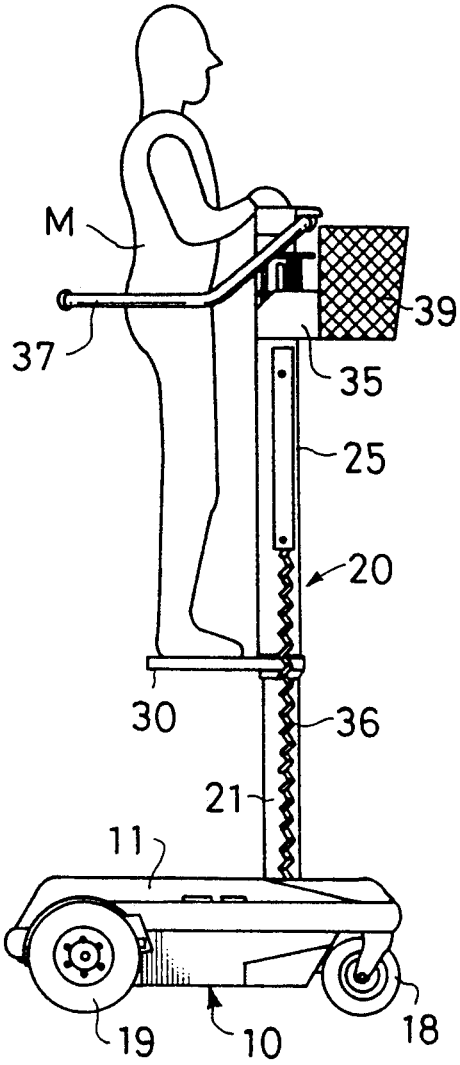
Figure 2:
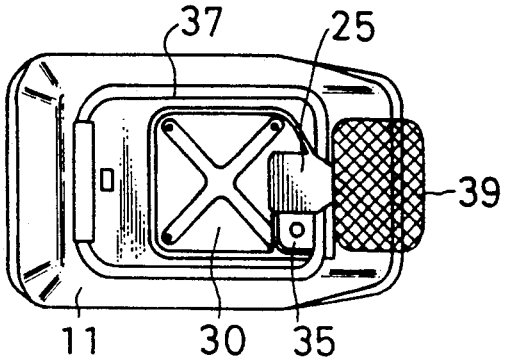
FIG. 2 is a top plan view of the compact aerial vehicle of the present invention.

Referring now to the drawings, there is illustrated in FIGS. 1A, 1B and 2 a compact aerial lift vehicle in accordance with a first embodiment of the present invention which comprises a body 10 having pairs of front wheels 18 and rear wheels 19, and a vertical post 20 vertically extending from on the body 10. The front wheels 18 consist of casters rotatably coupled to the body 10, while the rear wheels 19 are separately from each other driven by an electric motor as will be described later.

The vertical post 20 includes a lower post member 21 vertically extending from on the body 10 and removably attached thereto, and an upper post member 25 telescopically combined with the lower post member 21 so as to be vertically displaceable relative to the lower post member 21. A plate-like platform 30 for supporting an operator M is mounted on the upper post member 25 at its lower end. In order to support the operator M in an upright manner as shown in FIG. 1B, the platform 30 is made compact with a surface area enough to accommodate the operator M's feet. The upper post member 25 has at its upper end a handrail 37 for guarding the operator M standing upright on the platform 30. A small-sized basket 39 to be used as a receptacle is attached to the upper front of the upper post member 25.

The upper post member 25 further includes at its top a manual operating device 35 which is intended to control the travel of the compact aerial lift vehicle as well as the telescopic movement (or vertical displacement) of the vertical post 20. The manual operating device 35 having a vertical movement switch and a travel control lever is operated by the operator M standing upright on the platform 30. The vertical movement switch allows the upper post member 25 to be raised and lowered, which in turn vertically moves the operator M itself. The travel control lever is used to activate the electric motor to control the drive of the rear wheels 19, thereby controlling the travel of the aerial lift vehicle. The vertical post 20 further includes a cable 36 leading to the body 10 so as to transmit operation signals from the manual operating device 35 to the body 10.

Figure 3:
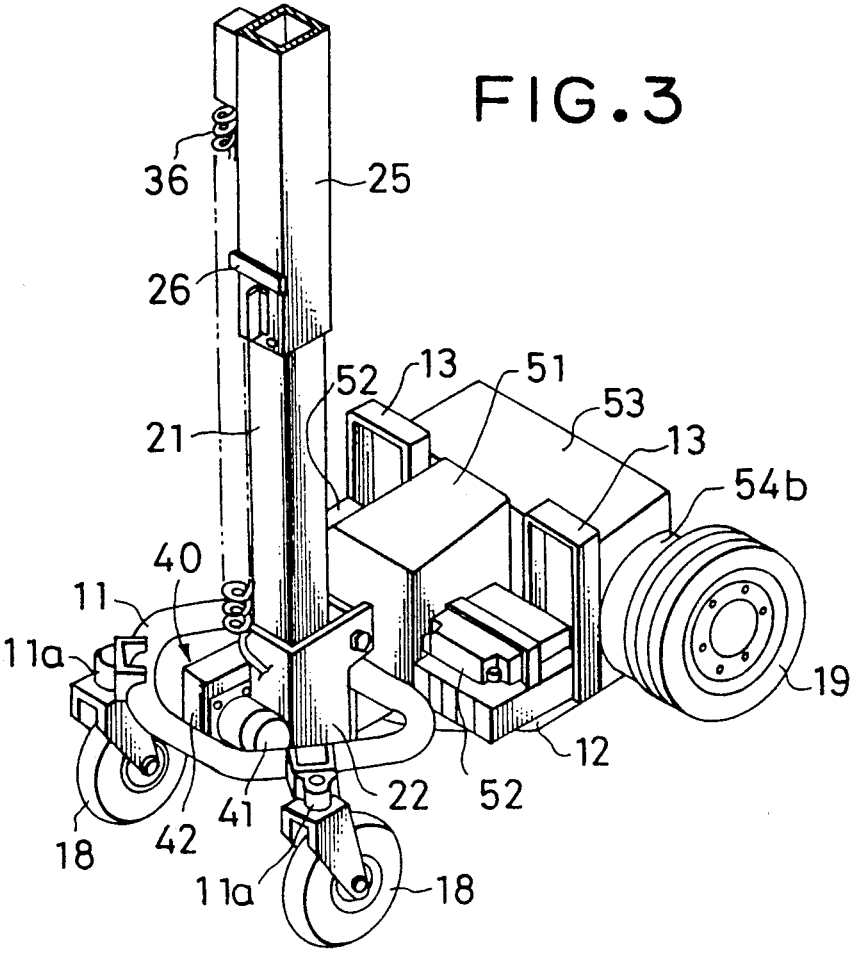
FIGS. 3 and 4 are perspective views showing the compact aerial lift vehicle according to the present invention with its body cover removed.
Figure 4:
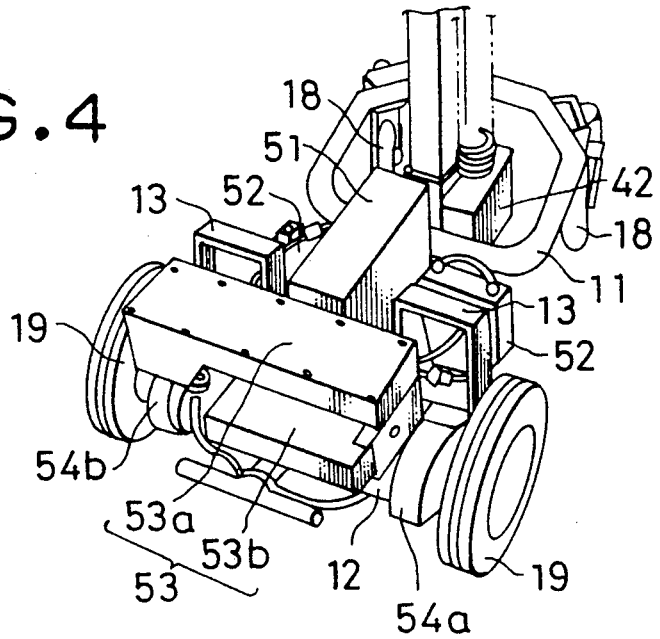

The body 10 is covered with a body cover 11. FIGS. 3 and 4 illustrate the construction of the body with the body cover 11 removed. The body 10 comprises a front frame 11 and a rear frame 12 integrally formed with the front frame 11.

The front frame 11 has a pair of right and left caster supporting members 11*a* fixedly secured to the front frame 11 and rotatably supporting the right and left front wheels (casters) 18, respectively.

The rear frame 12 is provided with a pair of right and left stays 13 for supporting the body cover 11. As shown in the figures, the rear frame 12 further includes a pair of right and left batteries 52, a charger 51, a controller 53, and a pair of right and left traction motors 54*a* and 54*b*.

The pair of right and left traction motors 54*a* and 54*b* are controlled by the controller 53, and driven separately with each other by power supplied from the corresponding batteries 52. Accordingly, the body 10 is allowed to move forward when the right and left traction motors 54*a* and 54*b* are forward rotated together, while the body 10 backs when the motors are reversed in unison. When the motors are differently rotated, the body 10 is permitted to turn its travel direction or can be steered. This travel control will be discussed later. Besides, the controller 53 is composed of a travel controller 53*b* for controlling the drive of the traction motors 54*a* and 54*b*, and a vertical movement controller 53*a* for the control of the drive of a vertical movement motor which will next be described.

Figure 5:
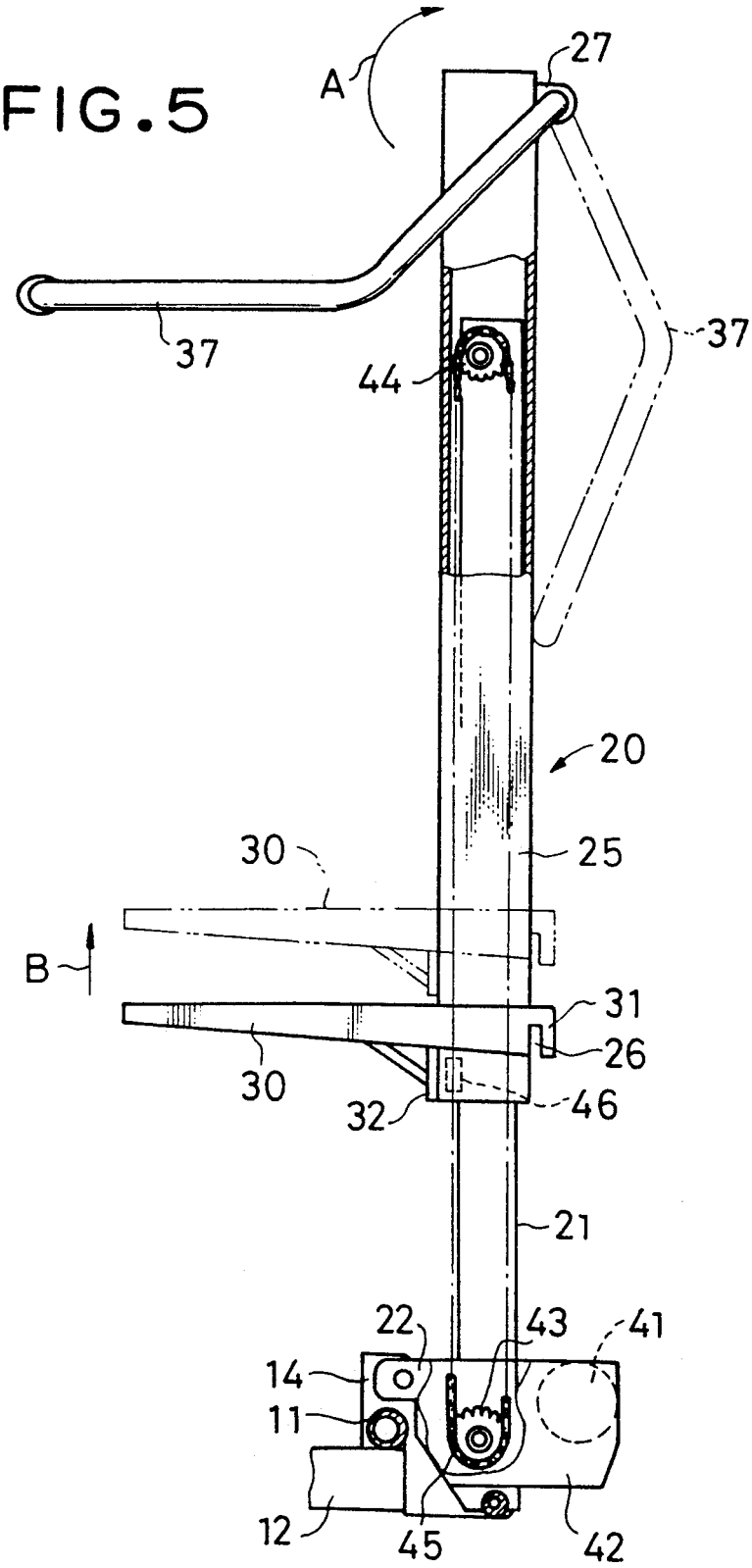
FIG. 5 is a side elevational view of the vertical post of the compact aerial lift vehicle.

FIG. 5 depicts the vertical post 20 in enlarged scale. The vertical post 20 is removably attached to the front frame 11 by means of a fitting member 22 integrally coupled to the lower end of the lower post 21. The fitting member 22 is provided with a reduction gear box 42 having the vertical movement motor 41. The lower post member 21 has at its lower portion a drive sprocket 43 which is rotatably attached thereto and driven by the vertical movement motor 41 through the reduction gear box 42. The lower post member 21 further includes at its upper portion an idler sprocket 44 rotatably mounted thereto with a looped chain 45 passing between the sprockets 43 and 44.

The chain 45 vertically extends through a space defined by the lower post member 21 and the upper post member 25 telescopically attached to the lower post member 21 so as to overlap the lower post member 21. The chain 45 is formed into a loop by way of a coupling member 46 which is in turn linked with the lower end of the upper post member 25. Due to this structure, the rotation of the drive sprocket 43 by the vertical movement motor 41 through the reduction gear box 42 causes the chain 45 to be driven, which results in a vertical displacement of the upper post member 25. The drive of the vertical movement motor 41 is effected by the vertical movement controller 53*a* in response to the operation of the vertical movement switch on the manual operating device 35.

Figure 6:
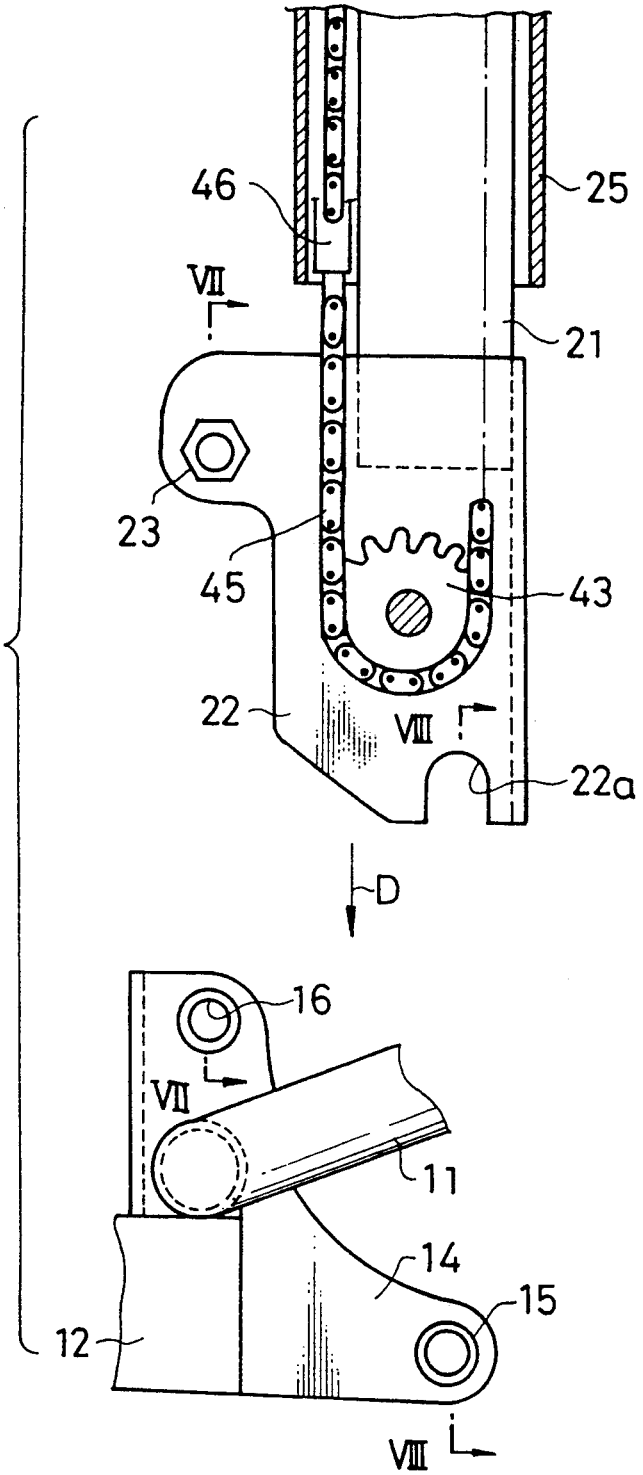
FIG. 6 is an enlarged side elevational view illustrating a coupling section between the vertical post and the body.
Figure 7:
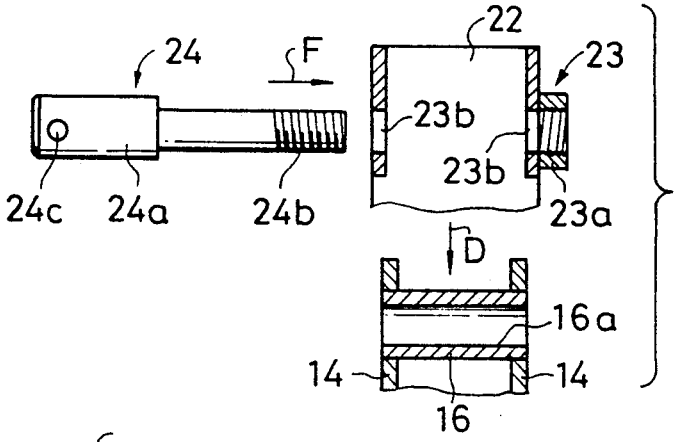
FIGS. 7 and 8 are sectional views of the coupling section taken along the arrows VII—VII and VIII—VIII, respectively.

The fitting member 22 integrally coupled to the lower end of the lower post member 21 is made of a plate material bent into U in section viewed from the lateral side. As is apparent from FIG. 6, the fitting member 22 has at its lower end an inverted U-shaped receiving recess 22*a* with a downward facing opening, and has at its upper rear portion a backward projecting locking structure 23. As illustrated in FIG. 7, the locking structure 23 includes a weld nut 23*a* joined to the outer side of the fitting member 22 by means of welding, an insertion hole 23*b* formed coaxially with the weld nut 23*a*, and a locking bolt 24 adapted to be fit into the insertion hole 23*b* and to be screwed with the weld nut 23*a*.

Figure 8:
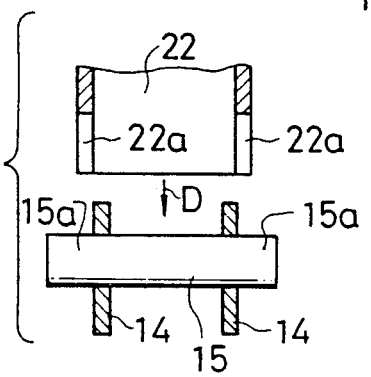

On the other hand, the body 10 has at its portion receiving the fitting member 22 a support member 14 fixedly secured to the body 10 and spanning between the rear frames 11 and 12. The support member 14 presents a forwardly projecting lower portion to which a fitting pipe 15 is rigidly secured with its right and left ends 15*a* each protruding outward from the support member 14 as shown in FIG. 8. The support member 14 also has at its upper portion a hollow pipe 16 firmly attached thereto as shown in FIG. 7. A through-hole 16*a* of the hollow pipe 16 has a diameter enough to receive a threaded portion 24*b* of the locking bolt 24.

Therefore, the fitting pipe 15 is forced into the receiving recess 22*a* of the fitting member 22 (in a manner as indicated by an arrow D in FIG. 8) so that the vertical post 20 is placed upright on the support member 14, whereby the fitting member 22 receives the support member 14 so that the insertion hole 23*b* of the fitting member 22 coincides with the through-hole 16*a* of the hollow pipe 16 of the support member. Then, the threaded portion 24*b* of the locking bolt 24 is forced into the through-hole 16*a* via the insertion hole 23*b* as indicated by an arrow F in FIG. 7, and screwed into the weld nut 23*a*. In order to facilitate this screwing, a head 24*a* of the locking bolt 24 includes a small hole 24*c* intended to receive a thin rod, a screwdriver or the like to easily turn the locking bolt 24.

As a result, with the both ends 15*a* of the fitting pipe 15 being fitted into the receiving recess 22*a*, the fitting member 22 is linked with the support member 14 by means of the locking bolt 24 in the locking structure 23, whereby the vertical post 20 can be easily mounted on the body 10 in an upright condition. On the contrary, by unscrewing the locking bolt 24, the vertical post 20 can be easily detached from the body 10.

Referring now to FIG. 5, the platform 30 has at its foremost end a hook 31 which is to be engaged with a locking bar 26 fastened to the lower front of the upper post member 25, thereby removably attaching the platform 30 to the upper post member 25. The platform 30 has on its underside a support arm 32. In addition to the engagement of the hook 31 with the locking bar 26 as described above, the abutment of the support arm 32 against the rear surface of the upper post member 25 ensures the attachment of the platform 30 to the upper post member. It is to be noted that the platform 30 is undesirably disengaged from the upper post member 25 as shown by a broken line in the figure providing that the platform 30 is pulled up under these circumstances.

To prevent this occurring, the locking bar 26 is designed to be locked to the upper post member 25 with the aid of a locking bolt, a locking pin or the like. As can be seen from this, when disengaging the platform 30 from the upper post member 25, the platform 30 has only to be pulled up after removing the locking bolt, locking pin or the like.

Figure 9:
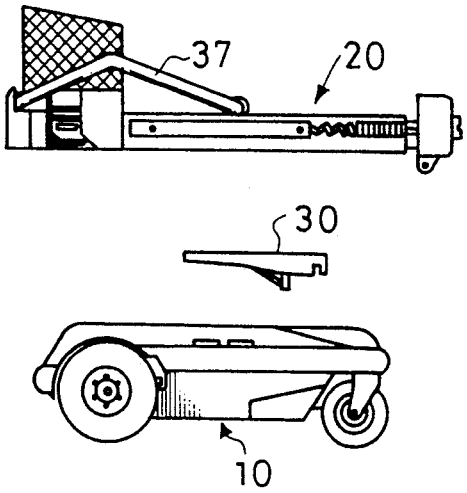
FIG. 9 is a side elevational view illustrating the compact aerial lift vehicle being disassembled.

In this manner, the vertical post 20 is detachably mounted on the body 10, while the platform 30 is removably attached to the vertical post 20. Thus, through the disengagement of the vertical post 20 from the body 10 and the detachment of the platform 30 from the vertical post 20, the aerial lift vehicle of the present invention can be disassembled into three parts as shown in FIG. 9. Such disassembly permits the body 10, the vertical post 20 and platform 30 to be separately conveyed and stored, which contributes to the substantial reduction in cost and space required for the conveyance and storage.

Incidentally, from a position (or the state shown in FIG. 1B) surrounding and guarding the operator M standing upright on the platform 30, the guard handrail 37 can be turned or jumped upward as indicated by an arrow A in FIG. 5, and folded up into a storage position resting along the front side of the upper post member 25 as indicated by a broken line. By virtue of this structure, the guard handrail 37 can be rotated into its storage condition as shown in FIG. 9 when the vertical post 20 is disengaged from the body 30 as described hereinbefore. Moreover, as the guard handrail 37 is allowed to be turned or jumped upward in this manner, the operator can get on or off the platform 30 without any difficulty (Refer to FIG. 14).

Figure 10:
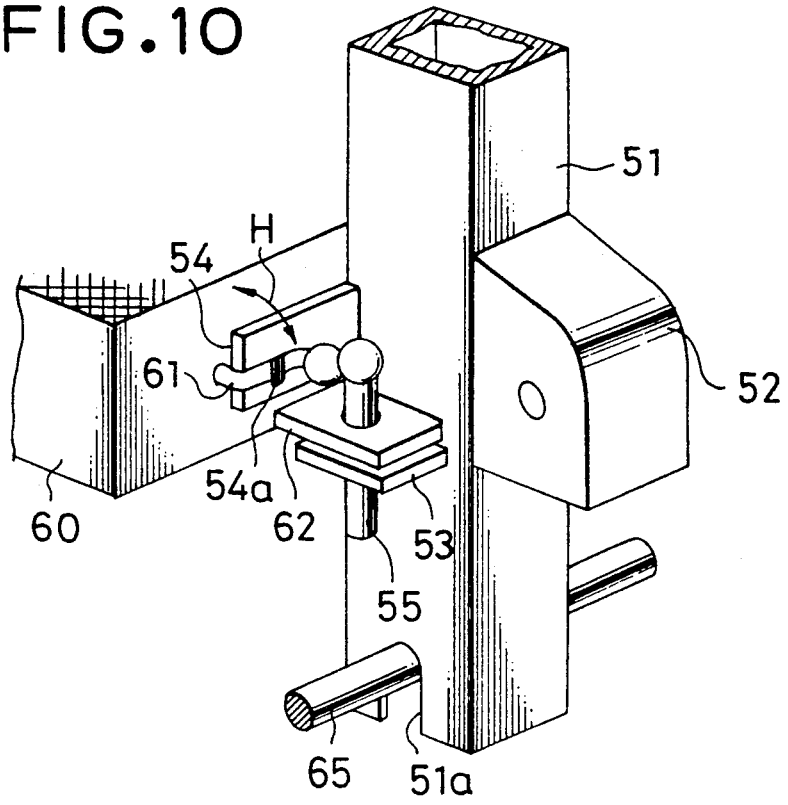
FIGS. 10 and 11 are a perspective view and a side elevational view, respectively, showing another constitutional example of the coupling section between the vertical post and the body.
Figure 11:
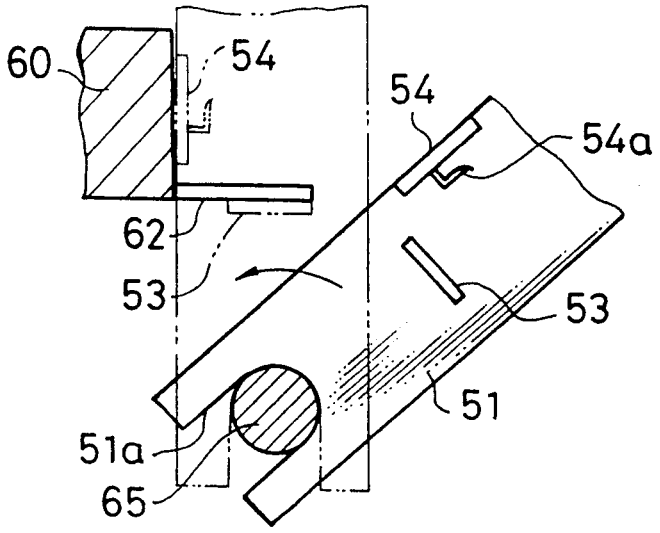

FIGS. 10 and 11 illustrate a second embodiment of the structure for detachably mounting the vertical post onto the body.

This aerial lift vehicle comprises a body frame 60 and a lower post member 51 having a gear box 52. The lower post member 51 includes a first locking plate 53 horizontally extending and attached to the side of the lower post member 51, and a second locking plate 54 vertically extending and secured thereto. In addition, the lower post member 51 has at its lower end surface a receiving recess 51*a*. On the other hand, the body frame 60 includes a lock plate 62 horizontally extending and secured thereto, a lock lever 61 rotatably mounted thereon as indicated by an arrow H, and a fitting pipe 65 integral with the body frame 60.

This structure permits the fitting pipe 65 to be forced into the receiving recess 51*a*, thereby uprightly placing the lower post member 51 on the fitting pipe 65. In this state, the first locking plate 53 confronts the lock plate 62, while the second locking plate 54 faces the side of the body frame 60 as can be seen from the figures. Then, a lock pin 55 is inserted into through-holes each provided in the first locking plate 53 and lock plate 62, thereby at this point locking the lower post member 51 (or a vertical post) to the body frame 60. At the same time, the lock lever 61 is rotated into a locking arm 54*a* disposed on the second locking plate 54, thereby also at this point locking the lower post member 51 to the body frame 60. Such two-point locking ensures a secure and reliable engagement of the vertical post with the body frame.

FIGS. 12 and 13 illustrate a third embodiment of the aerial lift vehicle of the present invention.

This aerial lift vehicle also comprises a body 77, and a vertical post 70 detachably mounted on the body 77 and including a lower post member 71 and an upper post member 72. The upper post member 72 has at its lower end a support member 73 fixedly attached thereto. A platform 75 is coupled to the support member 73 swingably up and down (as indicated by an arrow P in FIG. 12). This structure allows the platform 75 to be swung into a position resting along the upper post member 72 (or a position indicated by a chain line in FIG. 12) when the vertical post 70 is disengaged from the body 77, thereby realizing a compact aerial lift vehicle.

Also, this aerial lift vehicle has a handrail separated into two parts, that is, right 81 and left 82 handrails. The handrails 81 and 82 are each attached through a hinge 83 to the upper post member 72, each independently capable of being turned or jumped upward. When getting onto the platform 75, the operator M conveniently has only to turn or jump one of the handrails 81 and 82 upward, since he or she goes aboard through one side of the vehicle as shown in FIG. 14.

Figure 15:
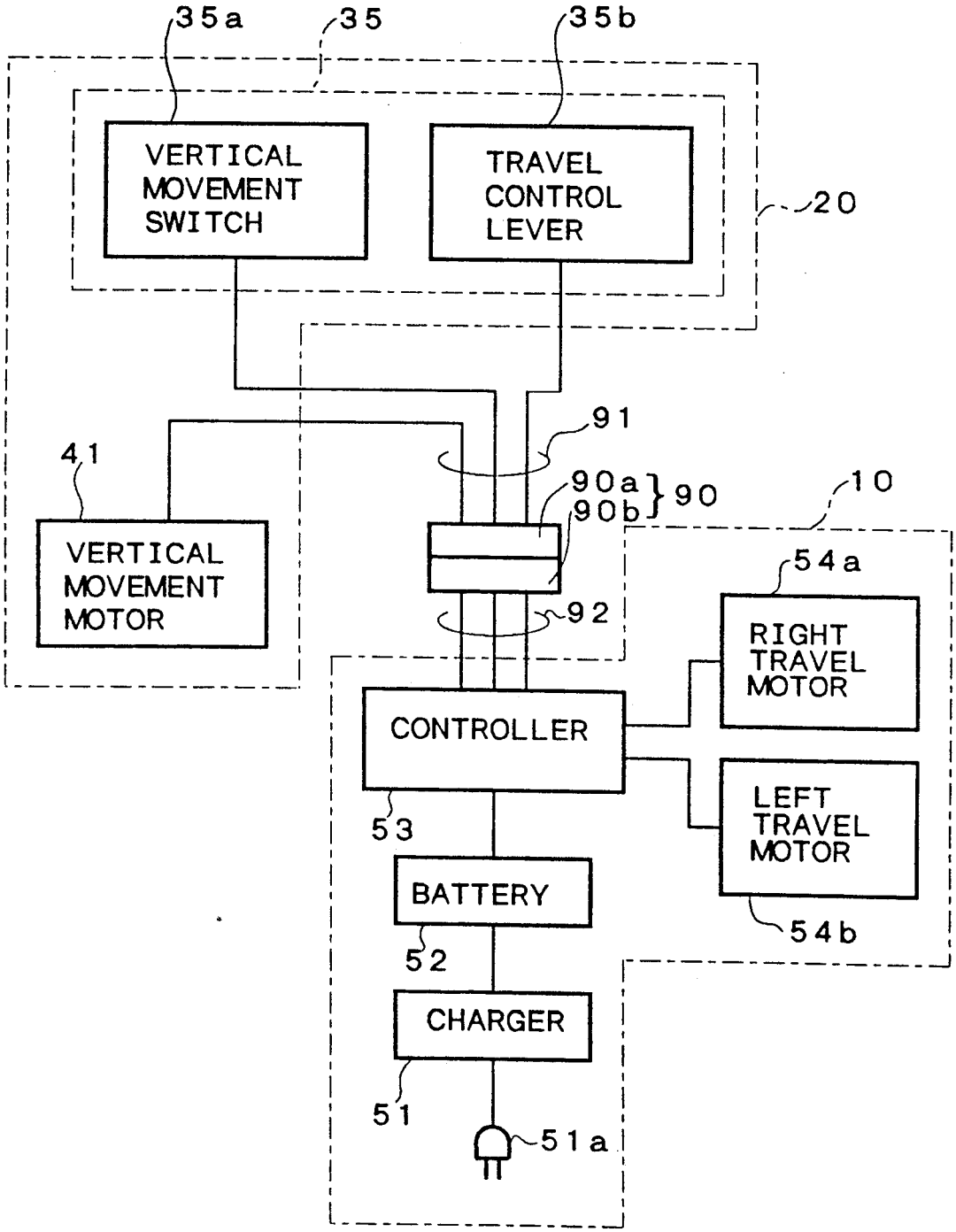
FIG. 15 is a block diagram of a controller incorporated in the aerial lift vehicle constructed in accordance with the present invention.

Based on the first embodiment shown in FIGS. 1 to 9, by way of example, the configuration of the travel and vertical movement controller incorporated in the aerial lift vehicle according to the present invention will next be described with reference to FIG. 15.

As discussed hereinbefore, the vertical post 20 is fitted with the vertical movement motor 41, and the manual operating device 35 having a vertical movement switch 35*a* and a travel operation lever 35*b*. On the other hand, the body 10 is equipped with the controller 53, battery 52, charger 51, and right and left travel motors 54*a* and 54*b*.

When the controller 53 receives operation signals from the manual operating device 35, it controls the power supply from the battery 52 to the vertical movement motor 41 and the pair of right and left motors 54*a* and 54*b* in response to the control signals, thereby controlling the vertical movement of the upper post member 25 and travel of the vehicle. To this end, the component members are connected by way of signal cables to one another as shown. It is to be appreciated since the vertical post 20 is detachably mounted on the body 10 that a connector 90 consisting of male 90*a* and female 90*b* connectors is used to couple a post-side cable 91 leading to the members placed on the vertical post 20 (the vertical movement motor 41, vertical movement switch 35*a* and travel operation lever 35*b*) with a body-side cable 92 leading to the controller 53 disposed on the body 10. Thus, this connector 90 may be disconnected to sever the cables 91 and 92 at the time of disengagement of the vertical post 20 from the body 10.

Incidentally, the charger 51 has a plug 51*a* adapted to be inserted into electric outlets for domestic use. Thus, domestic electric power can be used for the charge of the battery 52.

What is claimed is:

1. A compact aerial lift vehicle having a vertically movable platform, comprising:

a body having wheels so as to be capable of traveling;

a vertical post detachably mounted on said body and vertically extending upward therefrom in a telescopic manner;

a platform attached to the upper portion of said vertical post and vertically movable corresponding to the telescopic movement of said vertical post;

a travel drive means which drives said wheels for the travel of said vehicle;

a telescopic drive means which drives said wheels for the travel of said vehicle;

a manual operating device attached to the upper portion of said vertical post and for drivingly controlling said travel drive means and said telescopic drive means, said device being operated by an operator boarding said platform; wherein said vertical post has at its lower end a receiving recess, and said body has a fitting section to be fit into said recess, and said vertical post has at its portion above said lower end a locking mechanism to be locked with said body, and said vertical post is placed on said body in such a manner that said fitting portion is fitted into said receiving recess, and then said vertical post is locked to said body with the aid of said locking mechanism, thereby detachably mounting said vertical post member on said body so as to vertically extend upward therefrom.

2. A compact aerial lift vehicle according to claim 1, wherein said vertical post includes a fixed post member detachably mounted on said body and vertically extending upward therefrom, and a vertically movable post member mounted vertically slidably with respect to said fixed post member, and wherein said vertically movable post member includes said platform and said manual operating device attached thereto.

3. A compact aerial lift vehicle according to claim 2, wherein said telescopic drive means includes a drive motor secured to said fixed post member, and a chain mechanism, said chain mechanism having a pair of sprockets attached to the upper and lower portions, respectively, of said fixed post member, and having a chain passing between said sprockets;

and wherein said vertically movable post member is linked with said chain, and said drive motor rotates said sprocket, which in turn moves said chain, thereby telescopically displacing said vertically movable post member along with said chain.

4. A compact aerial lift vehicle according to claim 1, wherein said locking mechanism includes a plurality of locking mechanisms each differently locked so that said vertical post can be locked to said body at a plurality of points.

5. A compact aerial lift vehicle according to claim 1, wherein said platform comprises a plate member having a surface area enough to accommodate both feet of an operator standing upright on said platform.

6. A compact aerial lift vehicle according to claim 1, wherein said platform is detachably mounted on said vertical post.

7. A compact aerial lift vehicle according to claim 1, wherein said platform is foldable by swinging from a working position projecting horizontally from said vertical post to a storage position resting along said vertical post.

8. A compact aerial lift vehicle according to claim 1, further comprising a guard member for guarding the operator standing upright on said platform and attached to said vertical post so as to surround said operator.

9. A compact aerial lift vehicle according to claim 8, wherein said guard member is swingably jumped upward from a working position surrounding the operator boarding said platform.

10. A compact aerial lift vehicle according to claim 9, wherein said guard member is laterally separated into two parts, each independently being swingably jumped upward.

11. A compact aerial lift vehicle according to claim 8, wherein said guard member is detachably mounted on said vertical post.

12. A compact aerial lift vehicle according to claim 1, wherein said vertical post has at its upper portion a receptacle which is vertically displaceable together with said platform.

13. A compact aerial lift vehicle according to claim 1, wherein said travel drive means includes an electric motor disposed on said body, said drive means includes an electric motor disposed on said vertical post, and said body further includes batteries for the supply of the drive power to said electric motors, and a controller for drivingly controlling said motors in response to the operation of said manual operating device, said vehicle further comprising:

a first electric cable leading to said manual operating device and said tetescopical drive means, each arranged on said vertical post;

a second electric cable leading to said travel drive means, said controller, and said batteries, each arranged on said body; and a disengageable connector for connecting said first and second electric cables;

wherein said first and second electric cables are separated from each other by decoupling said connector when disengaging said vertical post from said body.

14. A compact aerial lift vehicle according to claim 4, wherein said plurality of locking mechanisms includes a first and a second locking plate attached to a side of said vertical post to extend therefrom in horizontal and vertical directions, respectively, and said body includes a lock plate extending horizontally therefrom and a crank-form lock lever rotatively mounted thereon, the first locking plate and the lock plate having locking pin receiving through-holes, so that when said fitting portion is fitted into said receiving recess with said vertical post in an upright position, the lock plate and the first locking plate are in adjacent overlying relation with their locking pin receiving through-holes in registration so that a locking pin can be inserted therein and said lock lever can be rotated into locking engagement with said second locking plate.

* * * * *